US005123134A

United States Patent [19]

Alberto

[11] Patent Number: 5,123,134

[45] Date of Patent: Jun. 23, 1992

[54] METHOD FOR SUPPLYING STEAM TO AN AUTOCLAVE FOR DECATIZING

[76] Inventor: Pietro Alberto, Via Lamarmora, 16, Biella (Vercelli), Italy

[21] Appl. No.: 662,050

[22] Filed: Feb. 28, 1991

[30] Foreign Application Priority Data

Mar. 15, 1990 [IT] Italy ..... 19691 A/90
Feb. 8, 1991 [IT] Italy ..... 000327 A/91

[51] Int. Cl.[5] ..... D06B 5/18

[52] U.S. Cl. ..... 8/149.3; 68/5 C; 68/8

[58] Field of Search ..... 8/149.1, 149.3; 68/5 C, 68/7, 8; 34/16, 37, 51

[56] References Cited

U.S. PATENT DOCUMENTS 473,398 4/1892 Kirk et al. ..... 68/7
2,670,622 3/1954 Dourdeville ..... 68/8
3,270,429 9/1966 Alberto et al. ..... 8/149.3 X
3,879,965 4/1975 Champel et al. ..... 68/7 X

FOREIGN PATENT DOCUMENTS 2615910 10/1977 Fed. Rep. of Germany ..... 8/149.3
9046 of 1891 United Kingdom ..... 68/8

*Primary Examiner*—Philip R. Coe
*Attorney, Agent, or Firm*—Panitch Schwarze Jacobs & Nadel

[57] ABSTRACT

There is described herein an improved method for decatizing in an autoclave wherein steam is led into the jacket surrounding said autoclave, at a pressure level increasing up to a stationary level within the autoclave. That is obtained by means of an automatically and adjustably controlled throttling valve at the steam inlet to the jacket, the valve being for instance driven by means of a microprocessor routine, and having an autoclave inlet valve associated therewith. In case the outer jacket is missing there might possibly be provided only an automatically controlled autoclave inlet valve performing also as a throttling valve, in order to have a gradually increasing inlet pressure.

3 Claims, 1 Drawing Sheet

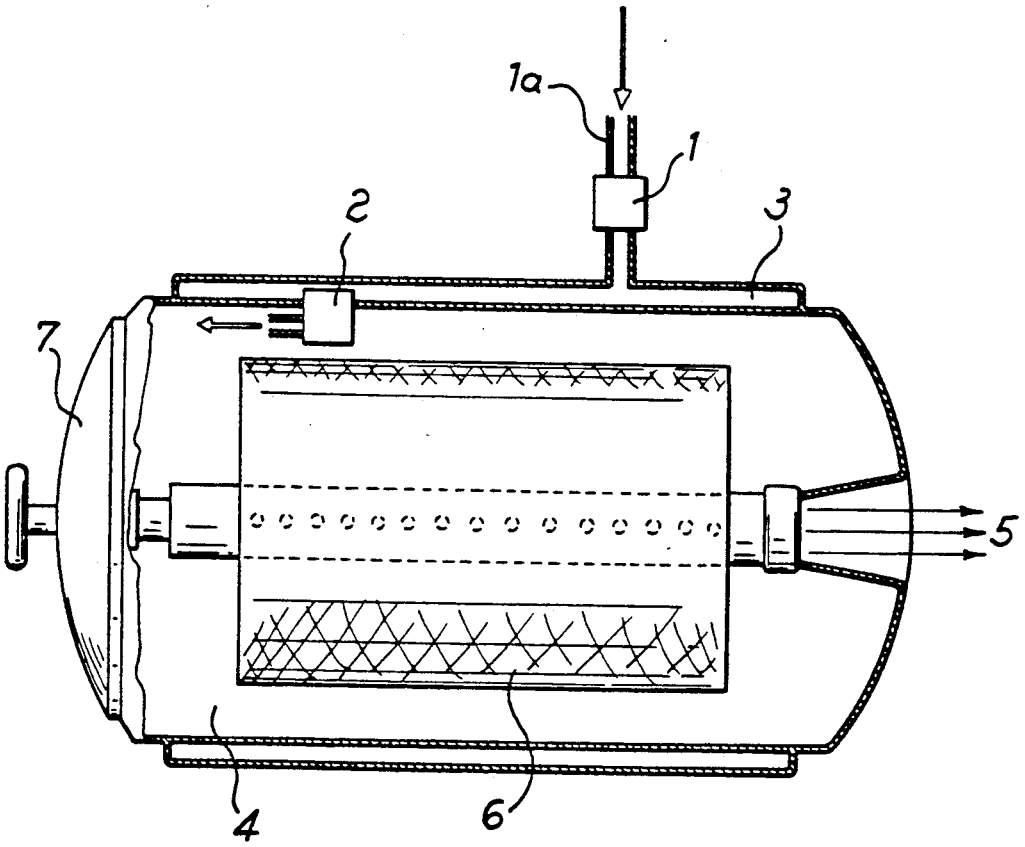
1a
1
2
3
7
5
4
6

METHOD FOR SUPPLYING STEAM TO AN AUTOCLAVE FOR DECATIZING invention concerns an improved method for steam decatizing fabrics in an autoclave.

As it is already known, for decatizing fabrics in an autoclave, the steam to be used, coming from a high pressure supply line, normally flows through a throttle valve which reduces the steam pressure to the values required by the decatizing treatment, usually 2 atmospheres (about 28.44 psi). The autoclave is usually provided with an outer jacket which is flooded with said steam and has the double function of heating the actual autoclave in order to avoid condensation, and of equalizing the temperature of steam before the latter enters the autoclave. When starting the decatizing operation, steam is withdrawn from the outer jacket and introduced inside the autoclave by opening a valve thereof connected with some sensors (thermometers, pressure gauges, and so on..), in order to introduce steam in the autoclave until desired levels of pressure and/or temperature are reached.

It is also known that in the autoclave decatizing machines, as they have been used until now, the autoclave inlet pressure remains constant for the whole duration of the decatizing cycle, since constant set levels are used both for the throttling valve and for the inlet valve. Of course, still during the decatizing cycle, the pressure inside said autoclave is variable due to the filling by the steam coming in, at least until a stationary value is reached. In this way though, out of phase actions take place during the injection of steam coming from the jacket. The latter, coming into contact with the roll of fabric subjects it to a squeezing action which remains strong until all the steam has passed through said roll. In fact, while the autoclave chamber is flooded with steam, the central portion thereof is connected with the environment, for instance through a vent, possibly connected with a vacuum pump, provided at the core of said roll, which enables the air initially contained therein to be vented out, being displaced by said steam pressure. When all the air, and thereby the oxygen contained therein, have come out, the vent is closed and the autoclave may be pressurized. However, curing the transient, while steam floods the chamber surrounding the roll and the internal vent is open, the fabric is subjected to a high force in that the steam coming in has a high pressure already, for instance in the range of 1,2 atmospheres (about 17.1 psi). The pressure difference between the incoming levels and the vent connected to the environment is made possible by the resistance Opposed by the fabric roll, acting as a large filter.

Therefore, it should be apparent that, if predetermined pressure levels are desired inside the autoclave (for instance a final pressure of 1,5 atmospheres about 1.3 psi) the throttle valve will have to be already set initially at said level, as a matter of fact preferably at a slightly higher level because of the unavoidable pressure losses. Of course, the higher the pressure, the stronger the squeezing action on the roll.

To summarize, it will be stated that usually a conventional decatizing system is provided with valves which cannot be controlled (a steam pressure throttling valve set at a high level and an autoclave steam inlet valve, of the on/off type).

It is further known that said fabric roll squeezing effect, at the start of the decatizing cycle, causes a different decatizing action on the fabric layers located on the outside or on the inside of the roll, when taking into account that decatizing is due to a combination of two different actions like mechanical squeezing and the steam temperature. Therefore, the result is that the fabric portion wound around the outside of the roll and subjected to a stronger squeezing and to a higher temperature is treated differently from the portion of the fabric wound inside the roll, whereby also the final results on the fabric quality will be different.

Therefore, an improved decatizing method has been studied, which makes the subject of this invention, wherein the inlet steam pressure to the autoclave is not stationary, but it is made to change, in particular to increase progressively. This may be advantageously done by providing, for at least one of the valves (preferably the throttling valve) an automatic variation of the setting in connection with the autoclave internal cycle, for instance through a predetermined sequence whereby the jacket internal pressure is increasing starting from a reduced initial pressure of steam on the roll, when the inlet valve is first opened, to reach a maximum level when the autoclave internal vent is closed, or afterwards if the stationary maximum levels had not been reached at that time.

In such a way, the seam pressure acting on the roll will be lower than with the method known in the art, in that at any moment the inlet pressure will be lower than if the throttle valve were set at a fixed pressure level, which would unavoidably be the maximum to be reached inside the autoclave, or even higher.

Accordingly, the throttling valve, which is initially set at very low pressure levels, increases its set level as the autoclave internal pressure is increasing. In other words, it may then be said that the autoclave pressure level tracks the throttle valve set level, which in turn increases as the autoclave internal pressure increases. In such a way, during the whole filling cycle, there is never a large difference between the inlet steam pressure and the actual autoclave inner pressure.

It should be noted that, if the jacket surrounding the autoclave was not provided, with the steam coming directly from the line, there would be a single autoclave inlet valve, having both functions of inlet and throttling valve, and this valve would have to be controlled at progressively increasing pressure levels, in the fashion mentioned above.

These and other object, advantages and features of the improved decatizing me hod of this invention will become apparent from the following detailed description, referring to the only attached drawing, which shows schematically how the subject method may be applied on an embodiment of a jacketed autoclave.

Referring now to the drawing, steam coming from high pressure supply line 1*a* enters jacket 3 surrounding the autoclave 4, flowing through a throttling valve 1 wherein the pressure is reduced and brought down to the desired levels. According to this invention, valve 1, instead of being set a constant pressure level during the whole decatizing cycle, is set at variable pressure level, being automatically controlled in any known way, for instance by means of a microprocessor routine, by a timer, by a pressure gauge and so on, whereby the steam exit pressure is gradually increasing with time. When opening autoclave inlet valve 2, the steam flowing into the autoclave will initially have a lower level, and the pressure on roll 6 will be relatively low in that, during said initial step of the decatizing cycle, the pressure will certainly be lower than the level which would correspond to valve being set at a fixed pressure, as known in the art. The fabric roll 6 outer layers will then be subjected to a low level squeezing action, while the air present inside the roll, which damages the decatizing process due to the presence of oxygen therein, is led out through an inner vent 5, comprised for instance of the same perforated core of roll 6, connected to the outside along a passage through a vent.

While the pressure within autoclave 4 increases due to the resistance opposed by the roll which acts as a filter between the steam entering through valve 2, and vent 5, also the inlet pressure increases due to the way valve 1 is controlled, while valve 2 may be a simple on/off through valve. Still according to what is known in the art, if for example it is desired to obtain a stationary level of 1.5 atmospheres (about 21.3 psi) of the inner pressure in autoclave 4, for the decatizing cycle, the pressure at valve 1 will have to be set at approximately 2 atmospheres (about 28.44 psi). Therefore, when valve 2 is opened, chamber 4 is immediately impacted by steam having said high level of pressure and associated temperature, whereby the outer layers of roll 6 are subjected to a strong squeezing.

If instead it is desired to perform the decatizing treatment still at atmospheres (about 21.33 psi) with the method of this invention, valve may be controlled starting for instance from a pressure level of only 0.5 atmospheres (about 7.1 psi), which is gradually increased to gradually reach eventually the desired level of 1,5 atmospheres (about 21.33 psi). In this way the squeezing values will be drastically reduced in that in the starting unbalanced pressure period inside the autoclave, the pressure fabric roll 6 is subjected to is substantially lower. Therefore, the decatizing treatment non-uniformities on the roll are done away with and reduced, and the associated finishing action on the fabric lump comprising roll 6 is substantially more uniform going from the outer fabric layers to those wound more internally.

It should be noted that steam might also come directly from line 1*a*, without flowing through jacket 3, there being only provided a valve 1 which leads steam directly inside the autoclave. In such a case valve 1 performs also as inlet valve 2, but it is still substantially a throttling valve controlled at gradually increasing pressure levels, as mentioned before, according to this invention.

It should be understood that, if in autoclaves there were no flow inversion problems (from the outside to the inside, or from the inside towards the outside) there would be no need for two valves, but a single one would be enough. Since the manufacturing processes include both direction for introducing steam, it is apparent that two valves are required. It should also be apparent that what has been described above holds true also when leading steam in from the inside towards the outside of the roll, in that to a steam intake through the foraminous cylinder there corresponds a venting of air in the autoclave chamber surrounding the roll.

Additions and/or modifications may possibly be made by those skilled in this art, to the embodiment described and shown herein, for embodying the method of this invention, without exceeding the scope of the invention. It should be understood that the subject of this invention is also extended to an autoclave wherein, through associated actuating and control apparatus, such as valves and so on, the method of this invention is carried out.

What we claimed is:

1. An improved method for supplying steam to an autoclave for decatizing rolled fabric in the autoclave, wherein an air outlet vent is provided, characterized in that the pressure of the steam supplied to the autoclave is variable and gradually increasing as air is removed from the autoclave through the vent and the autoclave inner pressure increases, until a maximum pressure level of the supplied steam is reached which is equal to or higher than a predetermined pressure level within said autoclave for performing decatization upon closure of the air outlet vent.

2. The method of claim 1, wherein steam coming from a steam supply line (1*a*) is lead into the autoclave (4) through an automatically controlled supply valve (1) which variably and gradually increases the pressure of the steam supplied to the autoclave.

3. The method of claim 2, characterized in that steam is led into autoclave (4) through an inlet valve (2) in communication with a jacket (3) surrounding said autoclave said inlet valve (2) being supplied with steam through said automatically controlled supply valve (1).

* * * * *